US006845805B1

(12) United States Patent
Köster

(10) Patent No.: US 6,845,805 B1
(45) Date of Patent: Jan. 25, 2005

(54) TOOTHED DAYLIGHT BLINDS

(76) Inventor: Helmut Köster, Karl-Bleber-Höne 15, D-60437 Frankfurt am Main (DE)

( * ) Notice: Subject to any disclaimer, the term of this patent is extended or adjusted under 35 U.S.C. 154(b) by 0 days.

(21) Appl. No.: 10/019,183

(22) PCT Filed: Jun. 26, 2000

(86) PCT No.: PCT/EP00/05929

§ 371 (c)(1),
(2), (4) Date: Jun. 3, 2002

(87) PCT Pub. No.: WO01/00958

PCT Pub. Date: Jan. 4, 2001

(51) Int. Cl.[7] ..... E06B 3/06
(52) U.S. Cl. ..... 160/236
(58) Field of Search ..... 160/236; 359/831–837, 359/606

(56) References Cited

U.S. PATENT DOCUMENTS 4,509,825 A * 4/1985 Otto et al. ..... 359/592
4,519,675 A * 5/1985 Bar-Yonah ..... 359/595
4,773,733 A * 9/1988 Murphy et al. ..... 359/593
6,240,999 B1 * 6/2001 Koster ..... 160/176.1 R
6,367,937 B2 * 4/2002 Koster ..... 359/601

FOREIGN PATENT DOCUMENTS

DE 19543811 * 3/1997

* cited by examiner

*Primary Examiner*—Blair M. Johnson
(74) *Attorney, Agent, or Firm*—Koda & Androlia

(57) ABSTRACT

The flight guiding blinds of this invention are characterized in that the tooth sides showing towards sun incidence have an angle of inclination β essentially smaller in the area of the irradiation portion and larger at a larger distance from the irradiation portion, and the angles of inclination β increase following a concave curve path increasingly ascending from the irradiation area towards the reflection area, and at the upper side of light guiding blinds retro-reflected reaction is concentrated and a concentration zone is formed near irradiation portion and the concentration zone is disposed either in front of blind in the irradiation portion and/or on the underside of upper blind behind the irradiation portion, and on the upper side of a light guiding blind light radiation may be reflected at the individual teeth at and angle $\alpha_R<\alpha_S$.

25 Claims, 4 Drawing Sheets

TOOTHED DAYLIGHT BLINDS

BACKGROUND OF THE INVENTION

1. Field of the Invention

The present invention relates to light guiding blinds in accordance with the preamble of the main claim.

2. Prior Art

It has been known to provide blinds having toothed shape at the upper side thereof. In DE 195 43 811 A1 and in DE 42 39 003 C2, blinds are shown having a stepped, or toothed, respectively, upper side by which retro-reflection of the sun radiation impinging on the blinds can be effected.

From DE 196 03 293 A1 or from AT 394 883 B, furthermore, blinds have been known which include, towards sun incidence, a first portion which retro-reflects incident sun radiation into the exterior space.

A disadvantage of all these prior art devices preferably arranged in an interior space behind a glazing is to be seen in that sun radiation retro-reflected at the upper side of the blinds is guided, at least partly, at a very flat angle to the inner side of the roof or facade glazing. Particularly in case of heat protection and sun protection glazings, however, an extremely disturbing and undesired glare effect is experienced generated by mirroring in the glass panes since the latter mirror part of the retro-reflected rays back into the interior space. The mirrored light impinges from the inner side of the glass panes between the blinds into the interior space or directly into the observer's eye. This is the biggest problem when using highly reflective blinds. So far, this problem can be evaded only in that, by rotating about a horizontal axis, the blinds are closed so far that the glass pane itself is no longer visible. This, however, leads automatically to an extensive darkening of the interior space whereby the daylight guiding venetian blinds lose their original function of improved illumination of the interior room with daylight. In the exterior space, on the other hand, extreme glare of the road traffic and of the buildings on the other side is generated by the reflective blinds.

The problem of glaring on the inner side of the outer panes has not so far been scientifically examined since that problem does not come up when using commercial colored venetian blinds. This problem came up when attempts started to specifically deflect, by means of reflective blinds, daylight into the depth of an interior space. Glare in glass panes has been known from show windows, particularly in case of bright light in the exterior space and darker interior space. Even for one versed in the art it is surprising that extreme glare can come up in glass panes even during daytime when looking from a darker interior space into a bright exterior space.

The described problems consist particularly in optimized light guiding blinds wherein in order to avoid thermal charging, the light radiation is to be reflected back to the outer space by means of one single or by two reflections. At each reflection namely, heating up comes inevitably up since the reflectors in most cases reflect only 70 to 80% of the sun radiation. The remainder is absorbed and leads to undesired heating up of the window zone.

SUMMARY OF THE INVENTION

The present invention aims at providing glare-free daylight illumination while at the same time minimizing the number of reflections. Desirable are one to two reflections maximum at the upper side of the blind. Neither the problem of overheating nor glare by the panes is acceptable.

It is, therefore, the aim of the invention to develop novel structures of light guiding blinds which reflect sun radiation impinging on the light guiding blinds by one to two reflections so that reflection of the retro-reflection in the window panes does not generate any disturbing glare effects in the interior space. Accordingly, it is the aim to control the light guidance of retro-reflection by respective design of the upper sides and undersides of the blinds so that glare reflections in the panes cannot fall into the user's eye whether in standing or in sitting position in the interior space.

This problem is solved in accordance with the characterizing portion of the present invention.

The advantage of the invention is that by the concave shape of the prismatic toothed upper side of the blinds by one single reflection, retro-reflection is in principle retro-reflected at an angle $\alpha_R<\alpha_S$ back to the exterior space. $\alpha_S$ constitutes the position of a connecting line between the edge of a lower blind in the irradiation area and the edge of an upper blind in the deflection area on the interior space side. $\alpha_R$ constitutes the angle of the retro-reflected, or back-reflected, respectively, radiation related to the irradiation level, or the glazing level, respectively. The irradiation level is configured by at least two blind edges each of an upper blind edge each and a lower blind edge each in the irradiation area as viewed from the outer space. The reflection cross section is configured by at least two blind edges each of an upper blind edge each and a lower blind edge each in the reflection area as viewed from the interior space. If $\alpha_R<\alpha_S$, then it is guaranteed that there is no direct glare by reflection in the outer panes. For flatter angles of incidence or other positions of the blinds, respectively, glare-free retroreflection is also guaranteed by two reflections. By the shape according to the invention of the tooth sides showing to the sun, the light reflected from the upper side of a blind to the underside of the upper blind falls at an angle $\gamma<90°$, which leads to a light guidance on the inner side of the outer pane from above so that a reflection of the retro-reflected radiation cannot generate any disturbing glare effect in the interior space (FIG. 4). The radiation retro-reflected at the panes is again received by the upper side of the lower blind and is retro-reflected again.

The present invention constitutes a construction guideline according to which stepped or toothed blinds can be constructed so that glare in the outer panes is extensively excluded. Examples will explain the idea of the invention and interesting embodiments.

DETAILED DESCRIPTION OF THE INVENTION

Figure 1:
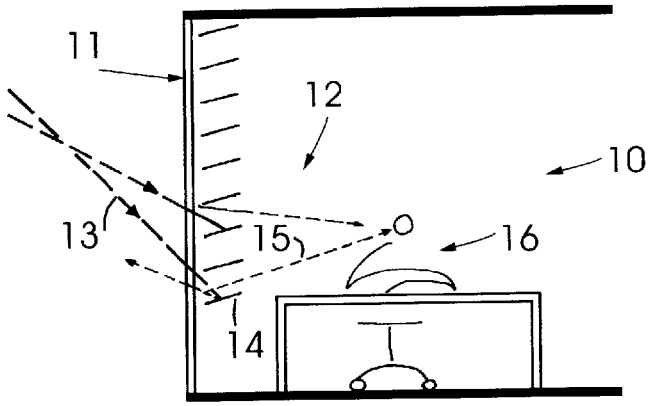
FIG. 1 shows the cross section through an interior space depicting the typical glare by retro-reflected radiation in the window pane (state of the art).

FIG. 1 shows, as known from the prior art, the cross section through an interior space 10 one side 11 of which is glazed. Behind the glazing, a daylight guiding venetian blind having reflective surfaces 12 is arranged. The problem is explained based on ray path 13. Inciding light radiation impinges on blind 14 and is retro-reflected by it into glass faced 11. In glass facade 11, a reflection is generated which, as shown by ray path 15, produces glare in the eye of observer 16. All prior-art retro-reflective blind structures having reflective upper sides, even prismatic retro-reflectors, show glare effects of the kind described. Only by constructing the blinds as in accordance with the present invention is it possible to reflect light radiation 17 back into the pane so that the observer in the interior space is not glared by the light reflection in glass facade 11. The solution is obtained by constructing the light guiding system with angles of incidence β of the teeth which increase as from the cross section of incidence, by which it can be guaranteed that $\alpha_R<\alpha_S$.

Figure 2:
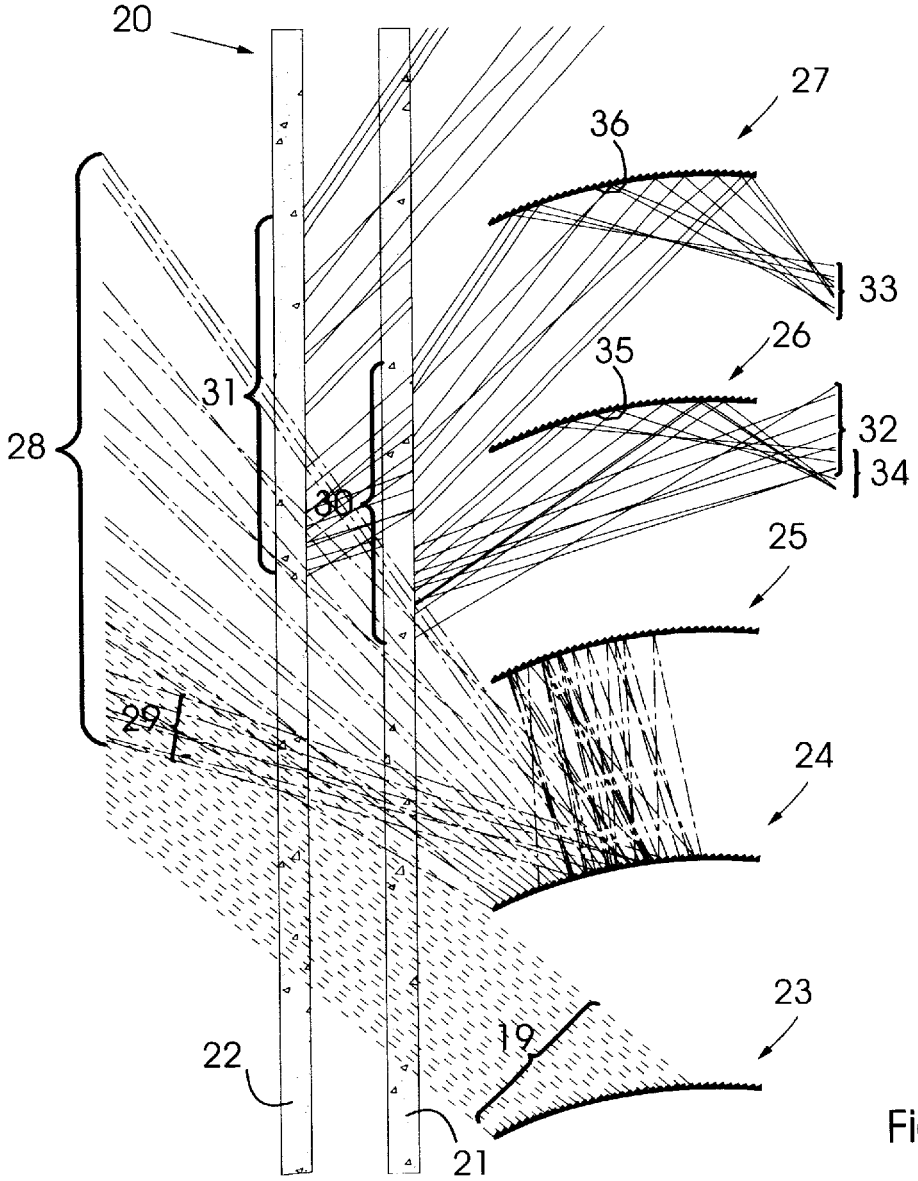
FIG. 2 shows an analysis of the ray paths as generally produced by reflective blinds and generating glare effects (state of the art).

FIG. 2 shows, also known from the prior art, an insulation glazing 20 comprising two panes 21 and 22 as well as toothed blinds 23 through 27 with the exact reflection paths based on which the glare problem is analyzed. To perform this analysis, special light radiation tracing programs have been developed by the inventor which were also employed for the construction of the blinds of the invention. Dashed ray bundle 19 falling onto blind 23 is retro-reflected on the upper side. This retro-reflection is shown on retro-reflecting toothed blind 24 as depicted by dash-dotted lines. It is only for the purpose of problem analysis that individual reflective ray paths 28, 29 and 30, 31, respectively, are split up and depicted separately. One portion of retroreflection 28 is guided by one single reflection into the exterior space, a further portion 29 is guided by a plurality of reflections between blinds 24 and 25 into the exterior space. Rays 28 and 29 are reflected at a certain percentage at the inner side of insulating glass panes 21, 22. Reflections on pane 21 show rays 30, the reflections on pane 22 show rays 31.

The reflection of the retro-reflection can be seen in the case of ray paths 32 from the interior space by glaring in pane 21. The reflection of the retro-reflection in case of ray paths 33, 34 can be experienced from the reflection and glaring on undersides 35, 36 of blinds 26, 27. These problems of glaring by reflection of retro-reflection as explained can be found in all structures of the state of the art described. These problems of glaring will be removed by the present innovation.

Figure 3:
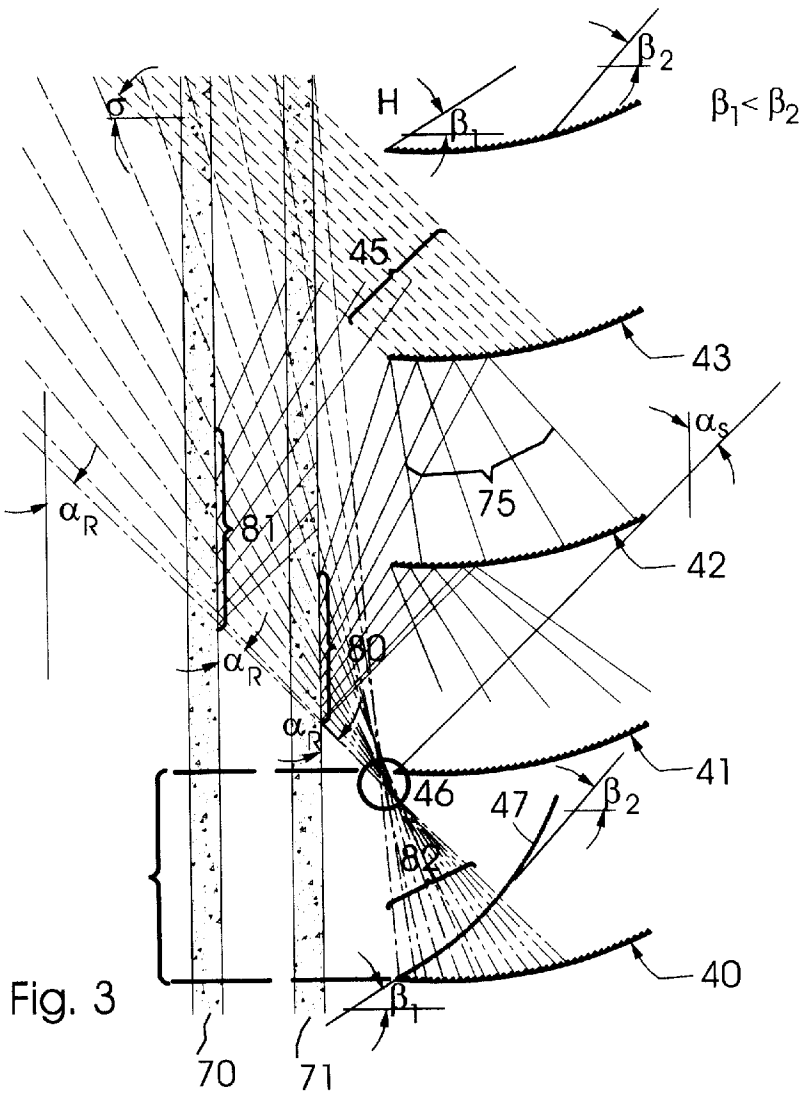
FIGS. 3 and 4 show an analysis of the ray paths for the innovative light guiding blinds in operable blind positions.

In FIG. 3, concave-shaped blinds 40 through 43 are shown the prismatic tooth angles of inclination β of which increase starting from the irradiation portion. Light radiation 45 inciding within an angle β is retro-reflected by one single reflection into the irradiation portion 44 so that a concentration area 46 is formed which, in FIG. 3, is situated in front of the irradiation portion. This is reached in that the angles of inclination β, for instance, starting from the irradiation portion increase as a concave curve 47 to the interior space. Individual teeth form projected segments of curve 47. The teeth subjected to incident light radiation may be of plane or arched shape. Even if the blind is composed of only two and a half teeth, as similar to FIG. 7, the construction guideline as described remains valid. The construction guide line is even valid in case of blind structures having only one single tooth. The larger the individual steps become the more necessary it becomes to concavely arch the tooth upper side. Ideally, though not necessary, curve 47 is approximate to a parabola having a focal point in concentration area 46. The tooth sides subjected to sun light may also be of concave or parabolic shape. This is particularly the case in structures according to FIG. 7 or for blinds having only one single tooth. In the case of smaller angles of incidence δ shown in FIG. 4 either readjustment of the blinds is necessary by providing them in a steeper position or the concentration area moves to the underside of the upper blind.

Figure 4:
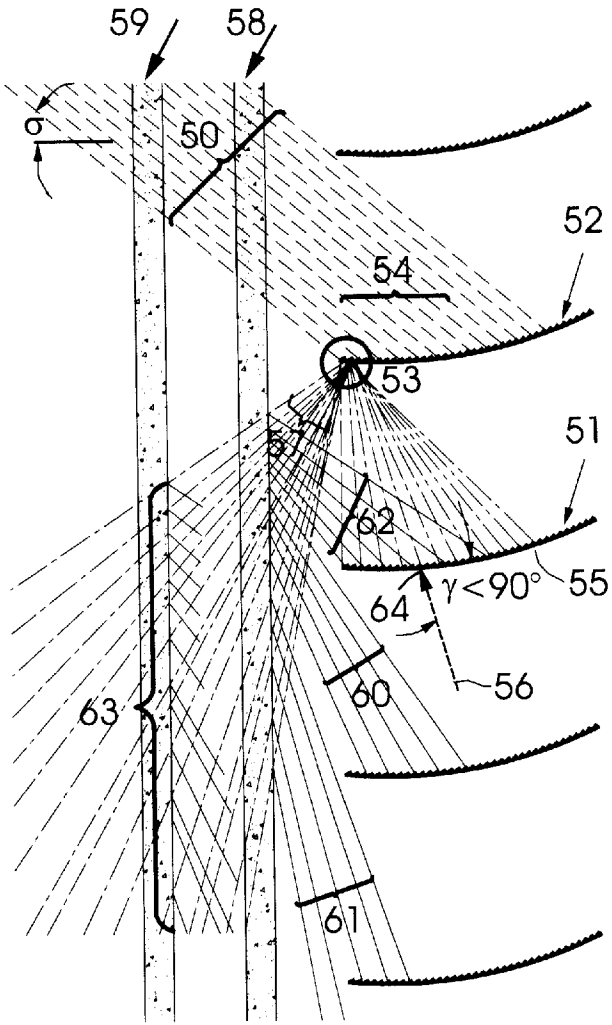

This process is shown by FIG. 4. A light bundle 50 falling on blind 52 is essentially reflected by one single reflection. These reflections are shown on the upper side of blind 51. The retro-reflection hits the underside of blind 52. The blind should be in such an angular position that concentration area 53 lies in portion 54 of blind 52 disposed towards the area of incidence. In this case, angles of impact $\gamma<90°$ are formed between blind underside 55 and a retro-reflected ray shown as an arrow 56 in point 64. Under these conditions, the light is guided as a ray bundle 57 from above onto glazing 58, 59 so that reflections 60, 61, 62 on a first pane 58 or reflections 63 on a second pane 59 impinge, in principle, on the upper side of the lower blinds. According to the invention, the reflections in panes 58, 59 are in any case glare-free for the observer in the interior space.

Reflections 80, 81 in panes 70, 71 of FIG. 3 are glare-free, too, since the light from panes 70, 71 is reflected to the underside of the upper blinds. Contrary to the prior art where the light reflected on underside 35, 36 of upper blinds 26, 27 is deflected into the observer's eye and to the bottom of the interior space, in FIG. 3 the light is guided by the underside of blinds 43, 44 onto the upper side of blinds 42, 43. Thereby, glare as a consequence of reflection 80, 81 of retro-reflected radiation 82 is also avoided at the undersides of the light guiding blinds. The mirroring of the reflection is not distinguishable. Only minutest radiation portions are steeply, i.e. also freely from glare, deflected to the bottom of the interior space.

While in each of FIGS. 3 and 4 linear, or point-shaped, respectively, light concentration is generated, such concentration is not necessarily essential. In order to avoid point-shaped heating-up of the blinds, the upper side of the blinds may so be designed that the light is distributed over a certain concentration zone.

Figure 5:
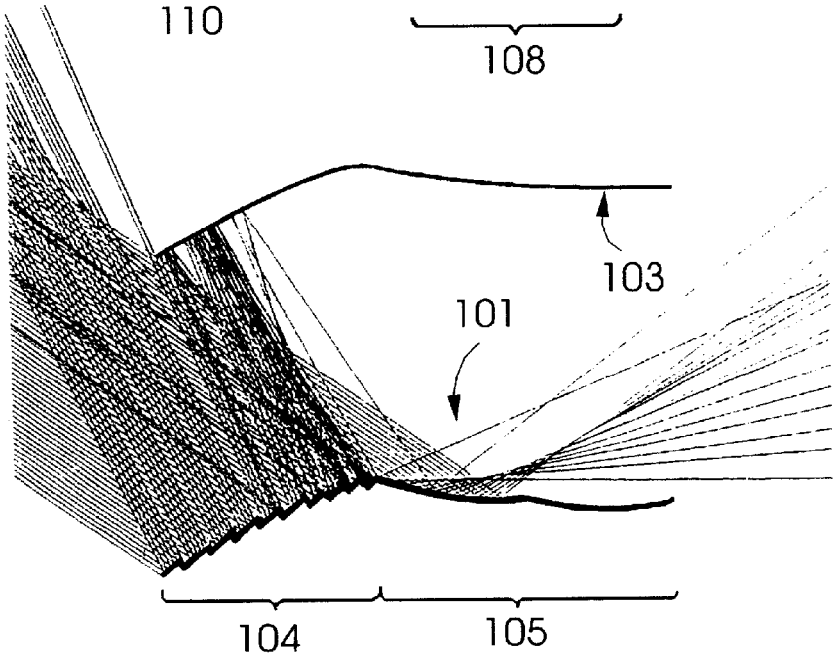
Figure 6:
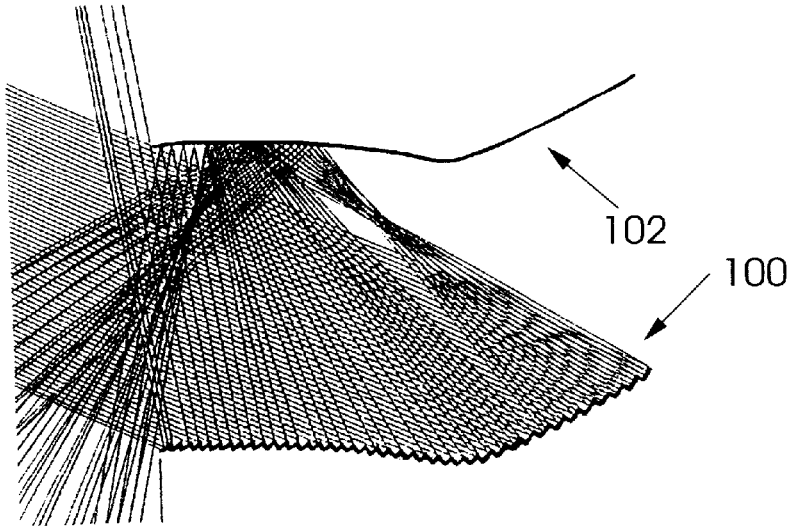

FIGS. 5 and 6 illustrate a further embodiment of the invention and the optical functions thereof at determined angles of incidence. In each case, the upper sides 100, 101 and the undersides 102, 103 of s-shaped blinds are shown. FIG. 5 shows a light guiding blind having a first portion 104 serving for retro-reflection and a second portion 105 serving for light flooding into the interior space. The first portion operates as in accordance with the explanations in connection with FIGS. 3 and 4. The same applies to the blind of FIG. 6.

Figure 7:
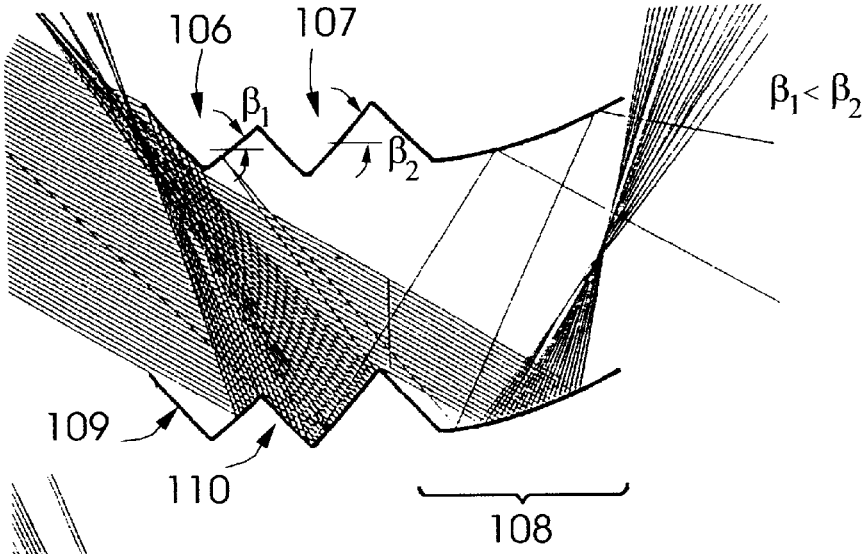
FIGS. 5, 6, and 7 show further exemplified embodiments of the blinds of the invention.

FIG. 7 shows a blind according to the invention which includes only two teeth, 106 and 107. The teeth are again designed as in accordance with the explanations in connection with FIGS. 3 and 4.

A second portion 108 guides light into the interior space. Contrary to FIGS. 3 through 6, the underside of the blind is toothed as well. For individual reflection paths, particularly in case of sun inciding at a small angle, it is very well possible that reflections between the blinds as well as on the underside of the upper blind might occur. It is essential of the invention that the blinds can retro-reflect sun irradiation having high angles of incidence, i.e. the overheating summer sun, by mere one or two reflections.

One interesting embodiment of the invention is so designed that the undersides of blinds 52, in portion 54 disposed towards the irradiation area, are provided with photovoltaic solar cells. In that case, the system also serves as a concentration installation for sun radiation.

A particularly interesting further embodiment consists in the structure of a raster element of blinds according to the invention wherein the horizontally-arranged blinds are orthogonally penetrated by further blinds which are either flat-shaped or toothed as well. The orthogonally penetrating blinds may also be made concave, convex or v-shaped. Such raster elements are particularly suited in flat or inclined glass roofs. In that case, the blinds are fixed in their angles of incidence.

The tooth structures of the light deflecting blinds according to FIGS. 3, 4, 5 and 6 are produced for instance by a rolling and embossing process and are brought into their particular concave/convex shape by a further roll-molding process. It is also possible to structure the light guiding blinds on their upper sides in tooth shape by one single rolling process from a thin strip and provide them, at the same time, with the desired shape by rolling. Covering a carrier material with micro structured foils is possible, too.

The light guiding blinds have a width of <15 mm and may be installed in the air gap of an insulating glass. However, the light guiding blinds may also take a width of >30 cm and may be covered, at least from above, by a pane or a foil. Still larger light guiding blinds may also be composed of a plurality on individual parallel blind elements. One could also think of casting the blinds into a transparent plastic material and making additional use of prismatic effects for light deflection. Tooth structures applied by an embossing process are hardly visible by the human eye and yet may optically, radiation-geometrically, operate in the way described. It is also possible to print holograms on the blinds, to roll in holograms or to laminate the blinds with foils carrying inscribed holograms. In what way ever the light guiding effects at the blind upper side are produced, the present invention describes the constructional method of light guiding optics.

The light guiding blinds of FIG. 7, for instance, are rolled-shaped from a reflective thin strip. A suitable method is also the aluminum pressing process with subsequent polishing, lacquering, eloxadizing, chromium-plating, metallic evaporation etc. It has also been known to employ a production process for light guiding blinds having prismatic surface shape by embossing, for instance in aluminum, by means of embossing rollers. The disadvantage is the little mold exactness of the individual tooth tips since under the embossing calender the material flows only under extreme pressure into the embossing structure. Hard aluminum material as employed in the blind-producing industry does not completely flow into the tooth tips. Plastic materials which are softer and may better be molded tend to restore, particularly in their behavior over a long period of time and under temperature charge in case of inciding sun radiation.

Microstructures have the disadvantage of collecting dust and soil. Dust particles are particularly smaller than those microstructures and stick to the prisms. For the dust particles, the prismatic structure constitutes a very large surface which may correspondingly become soiled.

A further disadvantage of the microstructures is the danger of injuring the surface. The smaller the structures the more homogeneous becomes the surface for individual charges. In other words, the sensitivity against scratches during subsequent treatment, tool traces or later wearing effects is reduced if it becomes manageable to make the structures substantially smaller.

In order to guarantee the desired exact glare-free light guiding behavior of the light guiding blinds having a toothed upper side, a 100 percent molding of the calculated light guiding surface is necessary, which cannot be obtained by means of the state-of-the art rolling methods or calender techniques. In particular, the edges of the individual teeth have to be sharp-edged since round edges constitute glare danger and irritations of the ray paths.

It is, therefore, the aim of the present invention to develop a coating and a coating technology adapted to each other which makes possible a molding exactness in the nano range and at the same time cures to such hard layers that neither mechanical strains during further processing or during use (scratches) nor thermal charges will lead to an impairment of the surface quality.

It is a further aim of the production process of the invention to develop a coating material together with an adapted coating process which makes possible the production of specifically directed material compositions and permits defined material properties such as for instance mirror effects for short and long-wave radiation at the surface, or a transparent coating on reflective underground, or self-purification effects.

Finally, it is the aim of the invention to provide a glare-free, very exact, light guiding venetian blind which permits economic production by one single production step.

The problem is solved in that surface molding is performed by means of a sol-gel coating into which either a prismatic surface is embossed by a rotation embossing roller or on which a prismatic surface is printed by a rotary printing roller, and which, during the course of, or immediately after, the embossing or printing step, receives at least an initial curing by feeding electromagnetic radiation and/or electron bombardment.

The advantage of the production process of the invention is a microscopically finely structured surface of ceramic hardness which can be embossed with least force and provides for a very exact and sharp-edge prismatic structuring up to nano range as well as a permanent maintenance-free surface.

The advantage of the production process of the invention, furthermore, is to emboss the prismatic structure into a sol-gel coating which, by a suitable material composite, may be provided with specific properties, on one side, and which safeguards the specific surface structure also in the nano range, on the other. The sol-gel coatings in combination with the coating process make it possible to obtain the functions of light refraction, light reflection, self-purification, mirror effect, surface hardness, surface brilliance, electric charge, and electric conductivity by one single working operation.

The properties mentioned do not only constitute a question of the material composite but rather of process technology, i.e. of the molding of the reflectoric structures, or nano structures, respectively, and of the curing of these structures in molding processes, or immediately after the molding process, in order to stabilize the structures in the transfer phase from sol to gel, or for final curing, respectively. The term "immediately" refers also to tenth of seconds or shorter periods of time.

While all sol-gel coatings may be applied onto a work piece by prior art wet processes such as rolling, doctor blading, wiping, pointing, whirling, dipping, embossing, the process steps for producing the light guiding blinds from a sol-gel material composite constitute a well balanced unit of material, embossing, curing for obtaining the desired precision in light deflection.

The advantage of the sol-gel coating is the built-up of a micro structure hardly recognizable by the human eye, or not recognizable at all, which is so fine that hardly any roughness of the surface can be perceived. This makes possible a particularly economic, thin coating thickness since only an extremely low consumption of coating material is required.

Figure 8:
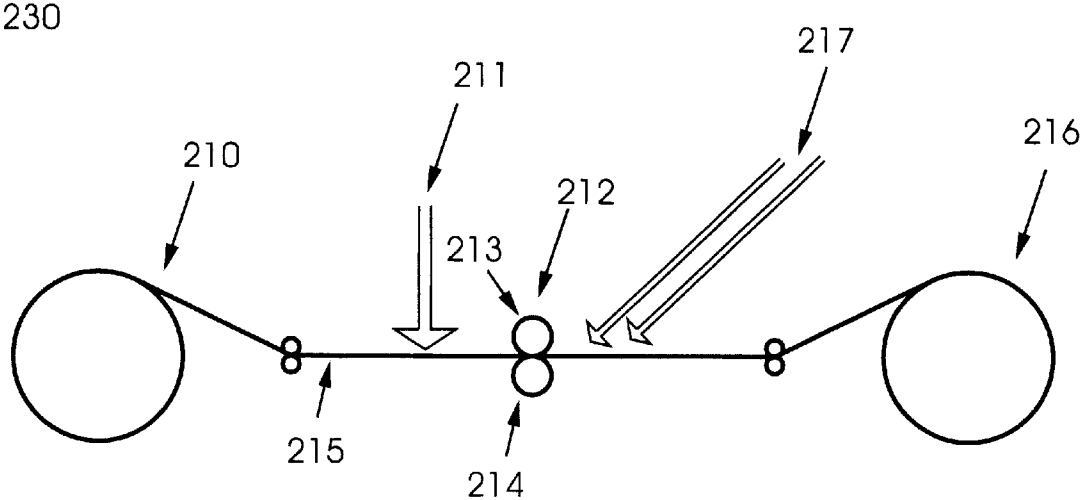
FIG. 8 shows an innovative production process of microstructuring by coating with sol gel.

FIG. 8 shows the principle of the production. Blind material 215 is unreeled as a strip from reel 210 and is provided with the sol-gel coating by means of a prior art wet coating process at coating station 211. Subsequently, the coated material is guided through roller pair 212. Lower roller 214 may for instance be smooth while upper roller 213 is structured and embosses its structure onto the sol-gel coating. Curing of the sol-gel coating is performed immediately behind the embossing roller. Curing is performed either by thermal irradiation 217 and/or by ultraviolet irradiation 217. The kind of irradiation depends on the material composite. It is preferred to employ polymerizing coating materials. After curing, the coated blind material might be re-reeled again onto a reel 216. It might also be of advantage to first provide thermal solidification by heat treatment up to 100° C. and subsequently obtain curing by ultraviolet irradiation, which is a two-step process. It is of particular advantage to provide the sol gel prior to the embossing process with an initial stiffness by means of light and/or thermal treatment and/or electron bombardment so that the micro structure cannot run any more.

It would for instance also be possible to coat the blind material on both sides, which means that in such case the lower roller 214 had to be shaped as embossing roller as well. It is furthermore possible to feed instead of the strip material. individual pieces, i.e. individual blinds cut to length and already profiled, into the coating apparatus. In place of an embossing roller, a printing roller may be employed as well wherein in such case the printing roller is coated in a well-known manner with the material composite and the printing roller transfers the material composite onto the work piece.

It is also an advantage of the process that upper and under sides may be coated during one working step with different material composites considering that the blinds have to fulfil different optical and light-technical functions on the upper and under sides thereof. In order to avoid glare, the underside may for instance be equipped with an anti-reflex coating consisting of photo-polymerizable ceramic nano particles.

Figure 9:
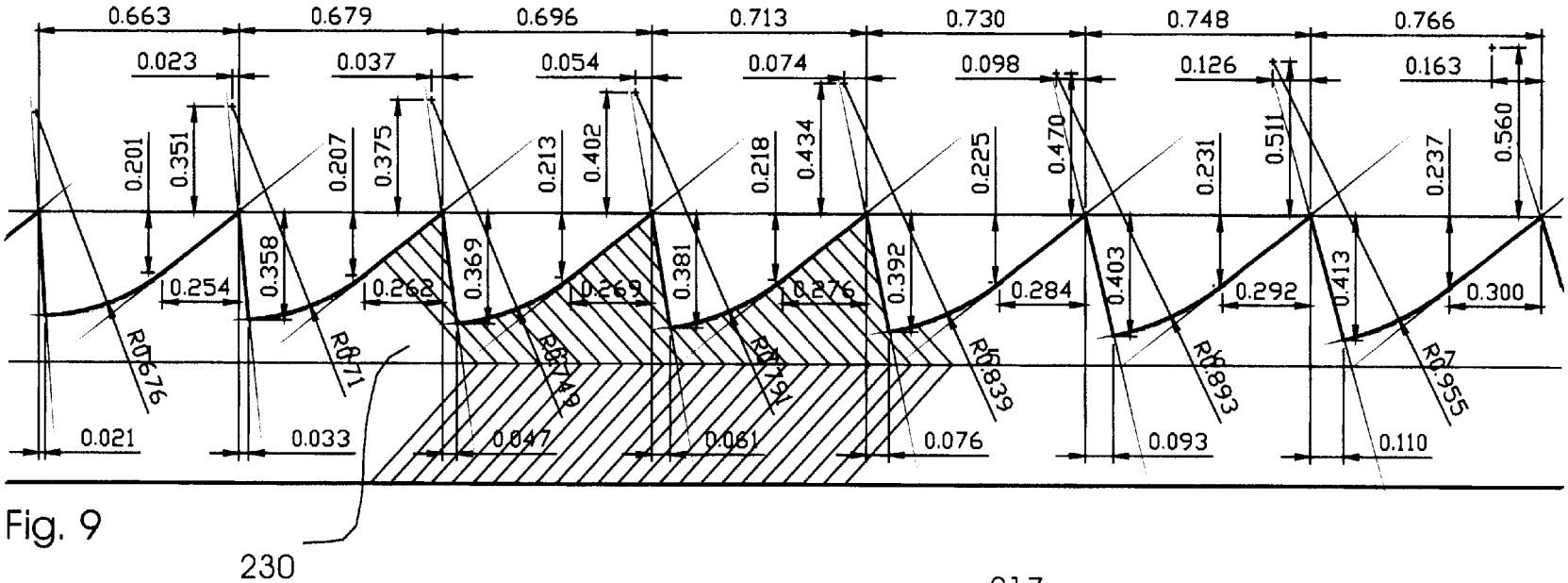
FIG. 9 shows an enlargement of a microstructurated surface.

FIG. 9 shows as an example a section of a finely-structured surface 230 in 400 fold enlargement. At this scale, one can see that the individual teeth constitute a complex mirror system comprising concave-shaped surfaces 230. In order to guarantee precise ray guidance, this surface should exactly be imaged. The required precision becomes possible by means of sol-gel coating by a printing or embossing process applied for instance on an aluminum blind.

In hitherto-known printing or coating processes for venetian blinds, organic colors or lacquers are employed which have the tendency to run or draw smooth at the surface. In general, this is in fact a desired property. According to the invention, however, particular inorganic sol-gel coatings are selected having the ability to permanently image embossings even in the nanometer range. It is also new to employ rotary, printing or coating processes for such sol-gel coatings. Material composites for the production of microstructured light guiding mirror surfaces or dereflective blind under sides have not so far been known either.

The advantage of sol-gel coatings is seen in the built-up of three-dimensional inorganic networks from a liquid phase which when cured come up to the hardness of ceramic materials. The inorganic networks may be incorporated in organic networks such as photopolymerizable acrylates so that organic and inorganic networks penetrate each other, the organic networks serving as supports in the sol-gel phase and for pre-solidification. The advantage of organic networks, therefore, consists in the possibility of curing the coating by heat and/or ultraviolet irradiation.

In the following, special requirements and formulations of the sol-gel coatings will be described, on one hand, and the preparation, or structuring, respectively, of the printing or embossing rollers for obtaining the specific effects described above, on the other, will be explained.

Into a polymerizable nano composite, nano scale particles may be incorporated. It is furthermore possible to incorporate precious metal colloids into the sol-gel coatings in order to thereby generate brilliance and mirror effects for light guidance. In this case, the work piece does not need any mirror coating. One working step is saved. Of particular advantage is the realization of a silver mirror of highest efficiency which will not, in the course of the time, oxidize and become clouded. A further protective layer is not necessary either.

Sol-gel coatings, moreover, make it possible to add nano particles to the composite (for instance $TiO_2$ or $Ta_2O_2$, or $SiO_2$ or $SiO_2/ZrO_2$).

In order to avoid undesired brilliance effects, for instance on portions of the blind undersides, or static effects, the sol gel may also be added self-organizing small particles which are generated by embossing an adhesive layer and show little adhesion. Such surfaces possess a super repulsion effect having high scratch and abrasive resistance and self-purification effect in view of a surface structure having a super hydrophobicity effect. These properties are obtained by a micro rough surface in the nano range with which the prism structured embossing or printing roller is covered.

As sol-gel materials, organically modified alkoxides and nano scale colloidal $SiO_2$ particles may be employed as well. Such coating materials may dry in a thermal or a photochemical process during the embossing process and cure to yield a vitreous layer. Structural heights may be formed from 1 nm to 100 nm. In place of $SiO_2$ particles, nanomeres may be employed as well. The particular advantage of this composite is that it is possible to emboss it with very low pressures so that the embossing rollers may be provided with flexible silicone surfaces which, on their part, may easily be produced and with a view to the small embossing pressure show only little wear.

The rollers, too, i.e. the surface of the rollers, for embossing, or printing, respectively, may be made of an inorganically/organically modified nano composite material into which, by means of photo-lithography and subsequent development or by means of photo structuring, holograms or the micro structure is incorporated through which, by the rotation molding and rotary printing process, the sol-gel coating of the work piece is surface treated.

Based on the sol-gel materials, or the sol-gel coating technique, respectively, special functional layer systems such as electro-chromic layers, intercalation layers, and transparent electrolytes, may be applied as well.

The invention relates as well to the application of further layers, for instance as electromagnetic screen or antistatic coating.

While in FIG. 9, prismatic structures have been shown reflecting light radiation on the surfaces as a result of the mirror effect, is also possible to apply highly transparent composites having prismatic structures 30 onto a mirror, for instance a reflective aluminum blind. In that case, the light is refracted in the layer and is guided.

The coating is applied either onto strip material split to venetian blind width or onto large working widths with structures repeating in parallel. The broad strips are subsequently, in a further operation step, split to a smaller venetian blind strip.

What is claimed is:

1. Light guiding blinds having at least partly prism molded toothed upper sides, said prism-molding being provided at least in a first portion of the blinds disposed close to an irradiation area and serving for deflecting daylight, said prism-molded teeth of one prism side showing towards sun incidence and with one reverse prism side showing towards the interior space, and two blind edges each on the sun incidence side forming an incidence portion and two blind edges each on the interior space side forming a deflection portion, and a blend edge of a lower blind each in the incidence portion and a blind edge of an upper blind each in the deflection portion forming an angle relative to inner blind edges, and sun irradiation impinging from outside being back-reflected at an angle relative to the outer blind edges in the direction of the outer space, the front side being the sum incidence side, said blind edges being in parallel relative to each other, characterized in that a) the individual prism-molded tooth sides shoaling towards sun incidence have angles of inclination relative to the horizontal, an angle of inclination being essentially smaller in the area of the incidence portion and an angle of inclination being larger at larger distance from the incidence portion, and b) the angles of inclination of at least one of the individual teeth and the tooth sides of a first and a second tooth showing towards sun incidence increases following a concave curve path increasingly ascending starting from the irradiation area towards the interior space, and c) at an upper side of light guiding blinds back-reflected radiation is concentrated and a concentration zone is formed near the incidence portion, said concentration zone is disposed in front of at least one of blinds in the incidence portion and on the underside of an upper blind behind the incidence portion, and d) on the upper side of the light guiding blind back-reflected light radiation is back-reflected at the individual teeth at an angle wherein a back reflection angle into the outer space is smaller than the angle between two blind edges of a lower blind in the incidence portion and an upper blind in the deflection portion.

2. Light guiding blinds according to claim 1, characterized in that said light guiding blinds are tilted in a position through which at the upper side of said blinds retro-reflected light radiation impinges at an angle $\gamma<90°$ on the underside of blinds.

3. Light guiding blinds according to claim 1, characterized in that said light guiding blinds are manufactured by a rolling process as a flat blind having uniform tooth formation and by subsequent concave/convex molding of the blind the individual teeth are brought into their ascend angular position.

4. Light guiding blinds according to claim 1, characterized in that said light guiding blinds include at least one portion oriented towards the interior space which, at least vis-à-vis a first portion, includes flatter tooth angles.

5. Light guiding blind according to claim 1, characterized in that said light guiding blinds are S-shaped.

6. Light guiding blinds according to claim 1, characterized in that said at least one first portion of said blinds and at least one second portion of said blinds serve as light guiding element for light guidance towards the interior space and wherein said first portion consists of at least said first and second teeth, the first tooth including on the side facing the sun light a flat angle of inclination, and at least said second tooth including a steeper angle of inclination, and that at least the sun-irradiated sides of the teeth are concavely arched.

7. Light guiding blinds according to claim 1, characterized in that said first portions of said blinds consist of at least one single tooth and at least the sun-irradiated side of said tooth are concavely arched, and the blinds include at least one second light guiding element for light guidance towards the interior space.

8. Light guiding blinds according to claim 1, characterized in that said light guiding blind upper sides are holograms.

9. Light guiding blinds according to claim 1, characterized in that on the underside in the area of a portion of blinds is disposed towards the irradiation area, energy converters for short-wave radiation into long-wave radiation and/or into current are provided.

10. Process of production of light guiding blinds according to claim 1 in a rotary process by feeding carrier material through a pair of rollers having structured surface, characterized in that microstructuring of said carrier material is obtained by means of a sol-gel coating into which either a prismatic-microstructured surface is embossed by a rotary embossing roller or a prismatic-microstructured surface is imprinted by a rotary printing roller, and which before, during or immediately after embossing or imprinting receives at least an initial curing by being fed electromagnetic radiation or by electron bombardment.

11. Process of production according to claim 10, characterized in that said sol-gel coating is a nanomer.

12. Process of production according to claim 10, characterized in that said sol-gel coating constitutes a synthesis of a viscous sol having a high solid content on an $SiO_2$ base, curing after thermal treatment to constitute a vitreous layer.

13. Process of production according to claim 10, characterized in that the substrate of said sol-gel coating constitutes a synthesis of inorganic-organic nano composites.

14. Process of production according to clam 10, characterized in that said substrate of said sol-gel coating constitutes a polymerizing nano composite into which nano scale inorganic particles are incorporated.

15. Process of production according to claim 10, characterized in that into said substrate of said sol-gel coating precious metal colloids are incorporated.

16. Process of production according to claim 10, characterized in that said substrate of said sol-gel coatings is formed of polymerizable silanes and cures through photo polymerization under the irradiation of ultraviolet light.

17. Process of production according to claim 10, characterized in that said substrate of said sol-gel coatings is produced by ceramic nano particles having a high metal oxide content ($SiO_2$, $TiO_2$).

18. Process of production according to claim 10, characterized in that said coatings consist of hydrolyzed methacryloxypropyl-trimetoxylane and said micro structuring is imprinted by an embossing roller.

19. Process of production according to claim 10, characterized in that said substrate of said sol-gel coatings consists of organically modified alkoxides and nano scale $SiO_2$ particles into which prismatic structures <30 nm are imprinted.

20. Process of production according to claim 10, characterized in that said substrate of said sol-gel coatings is a metal colloid containing coating.

21. Process of production according to claim 10, characterized in that said sol-gel coating applied onto said work piece is sprayed, in a second working step, with redistinguishable ITI nano particles and this sprayed-on layer cures under ultraviolet light as a protective layer.

22. Process of production according to claim 10, characterized in that the prism-molded surfaces are covered with transparent conductive layers selected from the group consisting of at least one of $In_2O_2$, $SnO_2$ and Sb sprayed at high temperatures onto a hot work piece surface having temperature of more than 300° C.

23. Process of production according to claim 10 or 20, characterized in that said prism-molded molding or printing rollers are structured having a low energy surface with self-structure nano particles so that with a view to repulsion effects a self-purifying surface results on the work piece.

24. Process of production according to claim 10, characterized in that said prism-molded molding or printing rollers are coated with a lubricant lacquer based on inorganic/organic nano composites.

25. Light guiding blinds according to claim 1, characterized in that said light guiding blinds include at least one portion oriented towards the interior space which is arch-shaped or plane.

* * * * *